US010682747B2

(12) United States Patent
Kuhnle et al.

(10) Patent No.: US 10,682,747 B2
(45) Date of Patent: Jun. 16, 2020

(54) PROTECTIVE DEVICE AT LEAST FOR PROTECTING A USER IN THE EVENT OF AN UNCONTROLLED BLOCKAGE OF A PORTABLE POWER TOOL

(71) Applicant: Robert Bosch GmbH, Stuttgart (DE)

(72) Inventors: Axel Kuhnle, Freiberg (DE); Lars Schmid, Nuertingen (DE); Carsten Diem, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 843 days.

(21) Appl. No.: 15/083,026

(22) Filed: Mar. 28, 2016

(65) Prior Publication Data

US 2016/0288308 A1 Oct. 6, 2016

(30) Foreign Application Priority Data

Mar. 30, 2015 (DE) ..... 10 2015 205 689

(51) Int. Cl.
*B25D 11/00* (2006.01)
*B25D 16/00* (2006.01)
*B25F 5/00* (2006.01)

(52) U.S. Cl.
CPC ..... *B25D 16/003* (2013.01); *B25F 5/001* (2013.01); *B25D 2250/141* (2013.01); *B25D 2250/145* (2013.01); *B25D 2250/165* (2013.01); *B25D 2250/221* (2013.01); *B25D 2250/371* (2013.01)

(58) Field of Classification Search
CPC ..... B25D 16/003; B25D 2250/165
USPC ..... 173/178
See application file for complete search history.

(56) References Cited

U.S. PATENT DOCUMENTS 3,521,497 A * 7/1970 Schmuck ..... B25D 16/00 173/108
3,774,699 A * 11/1973 Schmuck ..... B25D 16/006 173/48
4,066,136 A * 1/1978 Wanner ..... B25D 16/00 173/201
4,239,096 A * 12/1980 Smilgys ..... B27B 5/38 192/103 C
4,328,871 A * 5/1982 Gluskin ..... B25B 23/141 173/178
4,346,767 A * 8/1982 Vaughan ..... B25D 16/00 173/109
4,433,765 A * 2/1984 Rude ..... F16D 7/022 188/77 W
4,782,593 A * 11/1988 Kieser ..... B27B 17/083 188/77 R (Continued)

FOREIGN PATENT DOCUMENTS

DE 195 40 718 A1 5/1997
WO WO 2009156005 A1 * 12/2009 ..... B25D 16/003

*Primary Examiner* — Andrew M Tecco
*Assistant Examiner* — Eyamindae C Jallow
(74) *Attorney, Agent, or Firm* — Maginot, Moore & Beck LLP

(57) ABSTRACT

A protective device at least for protecting a user in the event of an uncontrolled blockage of a portable power tool includes at least one rotationally drivable shaft and at least one wrap-spring-free overload clutch unit which is arranged on the shaft and is configured at least to interrupt transmission of a drive force if a torque limit is exceeded. The protective device further including at least one wrap-spring clutch unit configured to brake the shaft.

16 Claims, 4 Drawing Sheets

(56) References Cited

U.S. PATENT DOCUMENTS

| | | | | |
|---|---|---|---|---|
| 4,967,888 | A * | 11/1990 | Lippacher | B25B 21/00 173/178 |
| 5,996,707 | A * | 12/1999 | Thome | B25F 5/00 173/171 |
| 6,415,875 | B1 * | 7/2002 | Meixner | B24B 23/028 173/171 |
| 7,055,620 | B2 * | 6/2006 | Nadig | B25D 16/003 173/176 |
| 7,506,694 | B2 * | 3/2009 | Stirm | B25F 5/00 173/176 |
| 2012/0255752 | A1 * | 10/2012 | Aoki | B25D 16/003 173/48 |
| 2012/0255756 | A1 * | 10/2012 | Aoki | B24B 23/02 173/178 |
| 2012/0261150 | A1 * | 10/2012 | Aoki | B25D 16/003 173/104 |

* cited by examiner

PROTECTIVE DEVICE AT LEAST FOR PROTECTING A USER IN THE EVENT OF AN UNCONTROLLED BLOCKAGE OF A PORTABLE POWER TOOL

This application claims priority under 35 U.S.C. § 119 to patent application no. DE 10 2015 205 689.9, filed on Mar. 30, 2015 in Germany, the disclosure of which is incorporated herein by reference in its entirety.

BACKGROUND

A protective device at least for protecting a user in the event of an uncontrolled blockage of a portable power tool is already known from DE 195 40 718 B4, wherein the protective device comprises at least one rotationally drivable shaft and at least one wrap-spring-free overload clutch unit which is arranged on the shaft and is intended to interrupt transmission of a drive force if a torque limit is exceeded.

SUMMARY

The disclosure proceeds from a protective device, in particular from a blockage protective device, at least for protecting a user in the event of an uncontrolled blockage of a portable power tool, having at least one rotationally drivable shaft and having at least one wrap-spring-free overload clutch unit which is arranged on the shaft and is intended at least to interrupt transmission of a drive force if a torque limit is exceeded.

It is proposed that the protective device comprises at least one wrap-spring clutch unit which is intended to brake the shaft, in particular to a standstill. Preferably, the wrap-spring clutch unit is intended to brake the shaft to a standstill in the event of an uncontrolled blockage. The term "intended" should be understood as meaning in particular specially designed and/or specially equipped. The fact that an element and/or a unit is intended for a particular function should be understood as meaning in particular that the element and/or the unit fulfill(s) and/or execute(s) this particular function in at least one use state and/or operating state. An "uncontrolled blockage of a portable power tool" should be understood here as meaning in particular sudden blocking of an application tool, arranged in a tool receptacle of the portable power tool, as a result of the application tool catching in a workpiece. In the event of such a blockage, there is the risk of injury to a user or persons located in the vicinity of the portable power tool, since the portable power tool can rotate in particular in an uncontrolled manner about a drive axis of the portable power tool in the event of such a blockage as a result of a force of a drive unit of the portable power tool.

A "wrap-spring clutch unit" should be understood here as meaning in particular a unit which comprises at least one wrap-spring element which is intended, depending on a wound state of the wrap-spring element, at least to connect at least two elements by means of a force-fitting connection or to interrupt a connection between the at least two elements. In order to connect the at least two elements, the wrap-spring element can bear against outer surfaces of the at least two elements, against inner surfaces of the at least two elements or against an outer surface of one of the at least two elements and against an inner surface of one of the at least two elements. Preferably, the wrap-spring clutch unit is intended to brake the rotationally drivable shaft by way of a force-fitting connection to a fixed element, in particular a bearing flange of the protective device. The wrap-spring clutch unit can be arranged at different positions, in particular at different positions on the portable power tool, for example at least partially on the shaft, in a transmission stage upstream or downstream of the shaft, viewed in an overall direction of action of the drive force of a drive train upstream or downstream of the shaft or at some other position that appears appropriate to a person skilled in the art within the portable power tool.

The overload clutch unit is preferably intended at least to interrupt a force flow between the shaft, in particular a pinion shaft intended to drive the tool receptacle in rotation, and the drive unit when a torque limit is exceeded. A triggering mechanism of the overload clutch unit can be configured mechanically or in a sensor-controlled manner. In a mechanical configuration of the triggering mechanism of the overload clutch unit, an interruption of a drive force is triggered in a manner already known to a person skilled in the art as a result of the exceeding of a retaining force between at least two elements of the overload clutch unit that cooperate in a form-fitting and/or force-fitting manner. In a sensor-controlled configuration of the triggering mechanism of the overload clutch unit, an interruption of a drive force is triggered in a manner already known to a person skilled in the art as a result of at least one sensor signal. Preferably, the triggering mechanism of the overload clutch unit is configured in a mechanical manner. The term "wrap-spring-free" should be understood here as meaning in particular a configuration of a unit, in particular the overload clutch unit, that is uncoupled from a wrap-spring element. The overload clutch unit preferably does not comprise a wrap-spring element. Preferably, the overload clutch unit is integrated in at least one transmission element, in particular a gear, of a transmission unit of the portable power tool. A triggering mechanism for the protective device in the event of an uncontrolled blockage of the portable power tool can be configured in a mechanical or sensor-controlled manner in a manner already known to a person skilled in the art.

By means of the configuration according to the disclosure of the protective device, high user safety can advantageously be achieved, since the portable power tool can be braked safely, and in particular stopped safely, after passing through a small rotation angle if an uncontrolled blockage occurs. Rotation energy of the portable power tool can advantageously be converted into thermal energy by braking of the shaft, in order to advantageously keep a possible rotation angle of the portable power tool small if an uncontrolled blockage occurs. Furthermore, safe braking of the shaft can advantageously be allowed, wherein the momentum of an, in particular running-down, drive unit of the portable power tool is advantageously able to be dissipated via the overload clutch unit.

It is furthermore proposed that the wrap-spring clutch unit comprises at least one driver element connected to a free end of the shaft, and at least one wrap-spring element, wherein the wrap-spring element cooperates with the driver element in order to brake the shaft. Preferably, the free end of the shaft is remote from an end of the shaft at which the overload clutch unit and/or a drive-force transmission region, in particular a toothing of the shaft, is/are arranged on the shaft. Preferably, at least one end of the wrap-spring element is fixed to the driver element. Preferably, the driver element is intended to trigger a winding movement, in particular winding up and/or unwinding, of the wrap-spring element and/or to transmit a brake force to the shaft. In particular, in at least one exemplary embodiment of the protective device, at least one surface of the driver element is configured as a brake surface which cooperates in particular with the wrap-spring element. By means of the configuration according to the disclosure, protection of the shaft can advantageously be achieved, since an action of brake forces on the shaft is realizable via the driver element. In addition, advantageously brake abrasion on a shaft surface of the shaft can advantageously be prevented.

Furthermore, it is proposed that the driver element is connected to the shaft for conjoint rotation. The expression "connected for conjoint rotation" should be understood as meaning in particular a connection of at least two elements which, via at least one complete revolution of the at least two elements, transmits on average a power flow with an unchanged torque, an unchanged direction of rotation and/or an unchanged speed. The driver element, in particular in at least one state of the protective device, can be connected to the shaft for conjoint rotation by means of a force-fitting, form-fitting and/or cohesive connection. Preferably, the driver element is connected to the shaft for conjoint rotation, and in particular fixed to the shaft, by means of a screw connection, by means of a press-fit connection or by means of the wrap-spring element. However, it is also conceivable for the driver element to be connected to the shaft for conjoint rotation by means of some other element that appears appropriate to a person skilled in the art or by means of some other manner of connection that appears appropriate to a person skilled in the art, for example by means of a riveted connection, by means of a welded connection, by means of an adhesive bond, by means of a latching connection, or the like. By means of the configuration according to the disclosure, reliable braking of the shaft can advantageously be achieved by braking of the driver element. In addition, gentle braking of the shaft can advantageously be realized, since brake forces act primarily on the driver element and are transmissible to the shaft as a result of the connection for conjoint rotation between the shaft and the driver element.

In addition, it is proposed that the wrap-spring clutch unit comprises at least one activation unit which has at least one movably mounted activation element which is intended to bring about a winding movement, in particular winding up and/or unwinding, of the wrap-spring element of the wrap-spring clutch unit as a result of a relative movement, in particular a relative movement relative to the shaft and/or to a bearing flange of the protective device. The activation element can be a separate actuating sleeve, a separate brake disk, the driver element or the like. Preferably, the activation element is mounted in a rotatable or twistable manner, in particular relative to the shaft and/or to the bearing flange of the protective device. Preferably, the activation unit comprises at least one actuator which is intended to move the activation element and/or to hold it in position. Preferably, the actuator is configured as a magnetic element, in particular as an electromagnet. However, it is also conceivable for the actuator to have some other configuration that appears appropriate to a person skilled in the art, for example a configuration as a spring element, as an electric motor, as a linear drive element, or the like. By means of the configuration according to the disclosure, reliable activation of the wrap-spring clutch unit can advantageously be achieved. Particularly preferably, the activation element is able to be held in an enabling position in which the wrap-spring element enables rotation of the shaft, by means of an electromagnet. An energy-supply-independent function of the wrap-spring clutch unit can particularly advantageously be achieved, since when energization of the electromagnet stops, automatic winding and thus braking of the shaft and/or of the driver element by the wrap-spring element can be achieved.

Furthermore, it is proposed that, in particular in at least one exemplary embodiment, the wrap-spring clutch unit comprises at least one activation unit which has at least one movably mounted activation element that is mounted so as to be twistable through an angle of less than 360°. The activation element is configured preferably as a sleeve, in particular as an actuating sleeve. Preferably, the activation element surrounds the shaft at least partially, in particular when viewed in a direction of rotation of the shaft. In particular, the activation element is mounted so as to be twistable through an angle of less than 270°, preferably less than 180° and particularly preferably through an angle of less than 90°, in particular relative to the shaft and/or relative to the bearing flange of the protective device. Preferably, at least one end of the wrap-spring element is fixed to the activation element. By means of the configuration according to the disclosure, it is advantageously possible to achieve a compact protective device which advantageously requires little installation space. In addition, an activation unit that is simple to implement in design terms can advantageously be realized.

It is furthermore proposed that, in particular in at least one exemplary embodiment, the protective device comprises at least one bearing flange on which the shaft is rotatably mounted, wherein the wrap-spring clutch unit has at least one wrap-spring element which bears against the bearing flange at least during a rotational movement of the shaft and is not in contact with the shaft or with a driver element, arranged on the shaft, of the wrap-spring clutch unit. Preferably, in at least one rotation-enabling position, as viewed in a direction extending at least substantially perpendicularly to a rotation axis of the shaft, the wrap-spring element is at a distance from the shaft and/or from the driver element which is in particular greater than 0.01 mm, preferably greater than 0.1 mm and particularly preferably greater than 1 mm, in particular when viewed in a coil region of the wrap-spring element which is free of a fixing region of the wrap-spring element, by means of which the wrap-spring element is fixable to an element. In a rotation-enabling position of the wrap-spring element, a free rotational movement of the shaft is advantageously possible. In a braking position of the wrap-spring element, the shaft is brakable preferably by an action of the wrap-spring element, since in particular the wrap-spring element bears against the shaft and/or against the driver element. Preferably, the protective device has at least one bearing element, in particular a rolling bearing element, which is arranged at the bearing flange. Preferably, the shaft is mounted on the bearing flange in a rotational manner by means of the bearing element. By means of the configuration according to the disclosure, a free rotation in a nonbraked state of the shaft can be realized in a simple manner in design terms. In addition, a force-fitting connection between the bearing flange and the shaft and/or the bearing flange and the driver element in order to brake the shaft can advantageously be realized.

In addition, it is proposed that, in particular in at least one exemplary embodiment, one end of the wrap-spring element is fixed to the bearing flange and another end is fixed to an activation element of an activation unit of the wrap-spring clutch unit, said activation element being twistable through less than 360°. Preferably, the wrap-spring element has at least one fixing protrusion in each case at the end and at the other end. The fixing protrusions extend preferably tangentially to an outer circumference of the wrap-spring element, at least substantially transversely to the rotation axis of the shaft and/or at least substantially parallel to the rotation axis of the shaft. By means of the configuration according to the disclosure, it is advantageously possible to achieve a compact activation unit which allows a reliable braking function of the wrap-spring clutch unit.

Furthermore, it is proposed that, in particular in at least one exemplary embodiment, the wrap-spring clutch unit comprises at least one wrap-spring element, one end of which is fixed to a driver element of the wrap-spring clutch unit, said driver element being connected to the shaft for conjoint rotation, and the other end of which is fixed to a rotatably mounted activation element of an activation unit of the wrap-spring clutch unit. Preferably, the driver element or an element of the activation unit that cooperates with a magnetic element of the activation unit forms the activation element. The activation element is preferably mounted so as to be rotatable through more than 360°, in particular mounted so as to be rotationally movable. The activation element is preferably formed from a magnetizable material, in particular a ferritic material. Preferably, in at least one rotation-enabling position, as viewed in a direction extending at least substantially perpendicularly to a rotation axis of the shaft, the wrap-spring element is at a distance from the bearing flange which is in particular greater than 0.01 mm, preferably greater than 0.1 mm and particularly preferably greater than 1 mm. By means of the configuration according to the disclosure, a particularly advantageous winding movement along an overall extent of the wrap-spring element can be achieved.

It is furthermore proposed that, in particular in at least one exemplary embodiment, the protective device comprises at least one bearing flange on which the shaft is rotatably mounted, wherein the activation unit has at least one magnetic element which is intended to produce a force fit between the bearing flange and the wrap-spring element as a result of a rotational movement of the activation element being braked. The magnetic element can be configured as a permanent magnet or as an electromagnet. In a configuration of the magnetic element as a permanent magnet, an action of a magnetic force on the activation element can be activated for example as a result of a relative movement of the magnetic element relative to the bearing flange. In a configuration of the magnetic element as an electromagnet, an action of a magnetic force on the activation element can be activated for example in dependence on a sensor signal and/or on an electrical switch signal. By means of the configuration according to the disclosure, advantageous controllability of activation of the wrap-spring clutch unit can be realized.

In addition, it is proposed that, in particular in at least one exemplary embodiment, the wrap-spring clutch unit comprises at least one wrap-spring element which has two different coil diameters. Preferably, the wrap-spring element has an abrupt change in coil diameter. Preferably, a coil diameter of the wrap-spring element is adapted to an outside diameter of a subregion of the bearing flange and a further coil diameter of the wrap-spring element is adapted to an outside diameter of the driver element. Different coil diameters of the wrap-spring element can be for example production-related or assembly-related. In the case of different coil diameters which are assembly-related, it is conceivable for the wrap-spring element to be pressed, in the region of at least one component, into at least one groove in the component, in particular in the driver element. In the case of different coil diameters which are production-related, it is conceivable for the wrap-spring element to already have at least two different coil diameters as a result of production. By means of the configuration according to the disclosure, precise guidance of the wrap-spring element can advantageously be achieved. In addition, a tendency of the wrap-spring element to roll can advantageously be kept low.

Furthermore, it is proposed that, in particular in at least one exemplary embodiment, the wrap-spring clutch unit comprises at least one wrap-spring element which is surrounded at least partially by the shaft. Preferably, the shaft has an inner cutout which has a maximum internal dimension, in particular inside diameter, that is smaller than a maximum external dimension, in particular outside diameter, of the wrap-spring element in an unloaded, in particular relaxed, state of the wrap-spring element. By means of the configuration according to the disclosure, a compact wrap-spring clutch unit can advantageously be achieved. In addition, the wrap-spring element can advantageously be guided in the shaft.

It is furthermore proposed that, in particular in at least one exemplary embodiment, the shaft has an internal cutout in which the wrap-spring element is fixed at least by one end. The wrap-spring element is preferably fixed in the shaft by means of a force-fitting connection. However, it is also conceivable for the wrap-spring element to be fixed to the shaft by means of some other manner of connection that appears appropriate to a person skilled in the art, for example by means of a force-fitting and/or cohesive connection (by means of a welded connection, by means of a riveted connection, by means of a latching connection, or the like). By means of the configuration according to the disclosure, a reliable brake-force action on the shaft can advantageously be achieved.

In addition, it is proposed that, in particular in at least one exemplary embodiment, the protective device comprises at least one bearing flange on which the shaft is rotatably mounted, wherein the wrap-spring element extends through a cutout in the bearing flange. The cutout in the bearing flange preferably has a maximum internal dimension which is greater than a maximum external dimension, in particular outside diameter, of the wrap-spring element in an unloaded, in particular relaxed, state of the wrap-spring element. By means of the configuration according to the disclosure, it is advantageously possible for the wrap-spring element to bear extensively against an inner wall, delimiting the cutout, of the bearing flange in order to brake the shaft.

Furthermore, it is proposed that the wrap-spring clutch unit is arranged at an end of the shaft which is remote from a further end of the shaft at which the overload clutch unit is arranged. The overload clutch unit is preferably arranged at an end of the shaft at which a drive-force transmission region, in particular a toothing of the shaft, is arranged on the shaft. Particularly preferably, the overload clutch unit is integrated in a spur gear, arranged on the shaft, of the transmission unit of the portable power tool. By means of the configuration according to the disclosure, appropriate use can advantageously be made of installation space that is already present.

A portable power tool, in particular a hammer drill or a hammer drill and chipping hammer, having at least one percussion mechanism unit and having at least one protective device according to the disclosure is furthermore proposed. A "portable power tool" should be understood here as meaning in particular a power tool for machining workpieces, it being possible for said power tool to be transported by a user without a transport machine. The portable power tool has in particular a mass which is less than 40 kg, preferably less than 10 kg and particularly preferably less than 5 kg. Particularly preferably, the portable power tool has a mass which corresponds to a value in a range of values from 4 kg to 13 kg. Preferably, the portable power tool is configured as a hammer drill or a hammer drill and chipping hammer. However, it is also conceivable for the portable power tool to have some other configuration that appears appropriate to a person skilled in the art, for example a configuration as a percussion drilling machine, as a screwdriver, as a drilling machine, as a gardening machine, as a planing machine, as a circular saw machine, or the like. By means of the configuration according to the disclosure, a high safety factor for a user of the portable power tool can particularly advantageously be realized. A user can particularly advantageously be protected from injury in the event of an uncontrolled blockage.

The protective device according to the disclosure and/or the portable power tool according to the disclosure should not in this case be limited to the above-described application and embodiment. In particular, the protective device according to the disclosure and/or the portable power tool according to the disclosure can have a number of individual elements, components and units which differs from the number mentioned herein in order to fulfill a functionality described herein. In addition, the ranges of values specified in this disclosure and values lying within said limits should be considered to be disclosed and able to be used in any desired manner.

BRIEF DESCRIPTION OF THE DRAWINGS

Further advantages can be gathered from the following description of the drawings. The drawings illustrate exemplary embodiments of the disclosure. The drawings, the description and the claims contain numerous features in combination. A person skilled in the art will also expediently consider the features individually and combine them into appropriate further combinations.

In the drawings.

DETAILED DESCRIPTION

Figure 1:
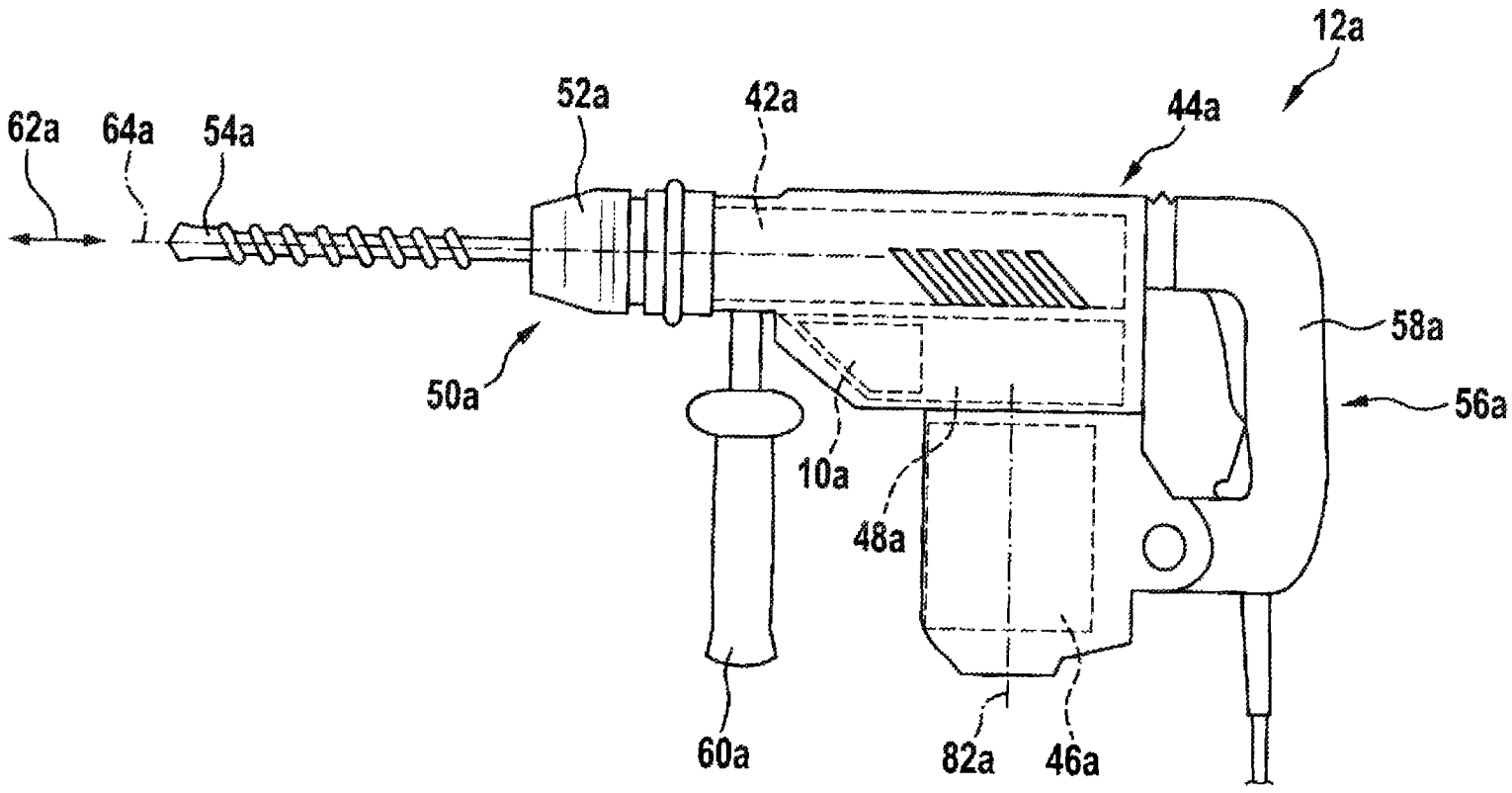
FIG. 1 shows a portable power tool according to the disclosure having at least one percussion mechanism unit and having at least one protective device according to the disclosure in a schematic illustration.

FIG. 1 shows a portable power tool 12*a* having at least one percussion mechanism unit 42*a* and having at least one protective device 10*a*. The portable power tool 12*a* is configured as a hammer drill or as a hammer drill and chipping hammer. The portable power tool 12*a* comprises a housing unit 44*a* at least for receiving the percussion mechanism unit 42*a* and the protective device 10*a*. Furthermore, the portable power tool 12*a* has at least one drive unit 46*a* and at least one transmission unit 48*a*. The drive unit 46*a* and the transmission unit 48*a* are arranged in the housing unit 44*a*. In addition, the portable power tool 12*a* comprises, in a front region 50*a*, a tool receptacle 52*a* for receiving an application tool 54*a*. On a side 56*a* remote from the front region 50*a*, the portable power tool 12*a* comprises a main handle 58*a* for guiding the portable power tool 12*a* and for transmitting a force from a user to the portable power tool 12*a*. The portable power tool 12*a* is embodied with a detachable auxiliary handle 60*a*. The auxiliary handle 60*a* can be fastened detachably to the portable power tool 12*a* via a latching connection or other connections that appear appropriate to a person skilled in the art. The auxiliary handle 60*a* is arranged on the portable power tool 12*a* in the vicinity of the tool receptacle 52*a* in order for the portable power tool 12*a* to be guided by the user. A main extension direction 62*a* of the portable power tool 12*a* extends from the main handle 58*a* in the direction of the tool receptacle 52*a*. The main extension direction 62*a* extends at least substantially parallel to a rotation axis 64*a* of the tool receptacle 52*a*. In order to generate a drive torque and to generate a percussive pulse by way of the percussion mechanism unit 42*a*, the portable power tool 12*a* has the drive unit 46*a*. The drive torque of the drive unit 46*a* is transmissible to the percussion mechanism unit 42*a* via the transmission unit 48*a* and/or the protective device 10*a* in order to generate the percussive pulse. The percussive pulse of the percussion mechanism unit 42*a* is able to be generated in a manner known to a person skilled in the art. A movement axis of a percussion element (not illustrated in more detail here), in particular a piston, a striker or an anvil, of the percussion mechanism unit 42*a* extends at least substantially parallel to the rotation axis 64*a* of the tool receptacle 52*a*. Furthermore, via the transmission unit 48*a* and/or via the protective device 10*a*, the drive torque is transmissible to the tool receptacle 52*a* in order to generate a rotational movement of the tool receptacle 52*a* via a hammer tube (not illustrated in more detail here) of the percussion mechanism unit 42*a*.

Figure 2:
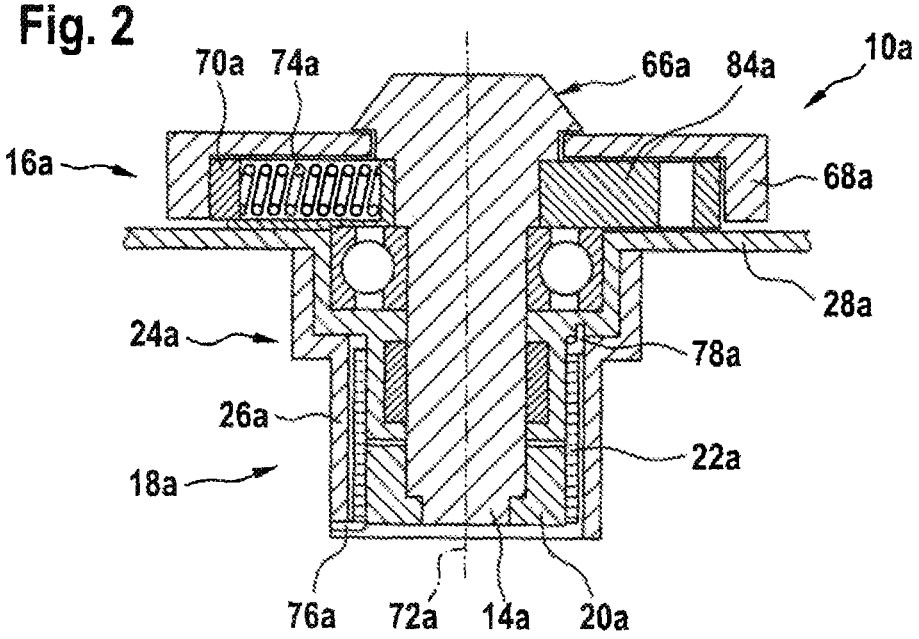
FIG. 2 shows a sectional view of the protective device according to the disclosure in a schematic illustration.

FIG. 2 shows a sectional view of the protective device 10*a*. The protective device 10*a* is intended at least to protect a user in the event of an uncontrolled blockage of the portable power tool 12*a*. The protective device 10*a* comprises at least one rotationally drivable shaft 14*a* and at least one wrap-spring-free overload clutch unit 16*a* which is arranged on the shaft 14*a* and is intended to interrupt transmission of a drive force if a torque limit is exceeded. The shaft 14*a* is preferably configured as a pinion shaft. The shaft 14*a* comprises at least one drive-force transmission region 66*a*. The drive-force transmission region 66*a* is connected to the shaft 14*a* for conjoint rotation. In particular, the drive-force transmission region 66*a* is configured in one piece with the shaft 14*a*. The drive-force transmission region 66*a* is configured as a gear. The drive-force transmission region 66*a* is intended to mesh with a gear element (not illustrated in more detail here), arranged on the hammer tube, of the percussion mechanism unit 42*a*. The hammer tube is drivable in rotation by the shaft 14*a*, in a manner already known to a person skilled in the art, in at least one operating state, in particular in a hammer-drill operating state. The overload clutch unit 16*a* is arranged on the shaft 14*a* at least substantially in a manner adjoining the drive-force transmission region 66*a*. The overload clutch unit 16*a* is integrated in a gear 68*a*, in particular in a spur gear, of the transmission unit 48*a* and/or of the protective device 10*a*. The gear 68*a* is mounted rotatably on the shaft 14*a*. The gear 68*a* preferably engages in a drive shaft, in particular an armature shaft (not illustrated in more detail here), of the drive unit 46*a*. A connection for conjoint rotation of the gear 68*a* and the shaft 14*a* is producible by means of the overload clutch unit 16*a*.

The overload clutch unit 16*a* comprises at least one movably mounted form-fitting and/or force-fitting element 70*a* which is intended to cooperate in a form-fitting and/or force-fitting manner with the gear 68*a*, in particular with an inner wall, facing the form-fitting and/or force-fitting element 70*a*, of the gear 68*a*. The form-fitting and/or force-fitting element 70*a* is movably mounted in a torque transmission element 84*a* of the overload clutch unit 16*a*. The torque transmission element 84*a* is connected to the shaft 14*a* for conjoint rotation. A movement axis of the form-fitting and/or force-fitting element 70*a* extends at least substantially perpendicularly to a rotation axis 72*a* of the shaft 14*a*. The rotation axis 72*a* of the shaft 14*a* extends preferably at least substantially transversely, in particular perpendicularly, to the rotation axis 64*a* of the tool receptacle 52*a* and/or to the movement axis of the percussion mechanism element of the percussion mechanism unit 42*a*. The rotation axis 72*a* of the shaft 14*a* extends in particular at least substantially parallel to a drive axis 82*a* of the drive unit 46*a*.

The overload clutch unit 16*a* furthermore comprises at least one spring element 74*a* which is intended to subject the form-fitting and/or force-fitting element 70*a* to a spring force in the direction of the gear 68*a*. The form-fitting and/or force-fitting element 70*a* is able to be pressed against the gear 68*a* by means of the spring element 74*a* in order to produce a holding force between the gear 68*a* and the torque transmission element 84*a*. If a torque acting on the gear 68*a*, and thus a force resulting therefrom, exceeds the holding force between the gear 68*a* and the form-fitting and/or force-fitting element 70*a*, transmission of a drive force is interrupted in particular in a manner already known to a person skilled in the art. It is conceivable for the overload clutch unit 16*a* to have a multiplicity of form-fitting and/or force-fitting elements 70*a* and/or a multiplicity of spring elements 74*a* which are intended to allow a drive force to be interrupted, in a manner already known to a person skilled in the art, if a torque limit is exceeded.

Furthermore, the protective device 10*a* comprises at least one wrap-spring clutch unit 18*a*, which is intended to brake the shaft 14*a*. The wrap-spring clutch unit 18*a* is arranged at an end of the shaft 14*a* that is remote from a further end of the shaft 14*a* at which the overload clutch unit 16*a* is arranged. The wrap-spring clutch unit 18*a* comprises at least one driver element 20*a* connected to a free end of the shaft 14*a*, and at least one wrap-spring element 22*a*, wherein the wrap-spring element 22*a* cooperates with the driver element 20*a* in order to brake the shaft 14*a*. The free end of the shaft 14*a* is that end of the shaft 14*a* that is remote from the overload clutch unit 16*a*. The driver element 20*a* is connected to the shaft 14*a* for conjoint rotation. The driver element 20*a* can be connected to the shaft 14*a* for conjoint rotation by means of a screw connection, by means of a press-fit connection, by means of an adhesive or welded connection or some other manner of connection that appears appropriate to a person skilled in the art. The driver element 20*a* is configured as a sleeve, in particular as a brake sleeve which cooperates with the wrap-spring element 22*a* in order to brake the shaft 14*a*. In particular, in order to generate a brake force in order to brake the shaft 14*a*, an external surface of the driver element 20*a* cooperates with an internal surface of the wrap-spring element 22*a*.

Figure 3:
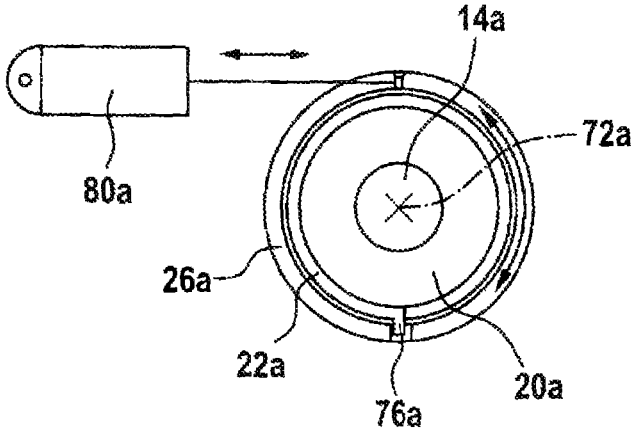
FIG. 3 shows a plan view of the protective device according to the disclosure in a schematic illustration.

The protective device 10*a* furthermore comprises at least one bearing flange 28*a* on which the shaft 14*a* is rotatably mounted, wherein the wrap-spring clutch unit 18*a* has at least the wrap-spring element 22*a*, which bears against the bearing flange 28*a*, at least during a rotational movement of the shaft 14*a*, and is not in contact with the shaft 14*a* and/or with the driver element 20*a*, arranged on the shaft 14*a*, of the wrap-spring clutch unit 18*a*. The wrap-spring clutch unit 18*a* furthermore comprises at least one activation unit 24*a* which has at least one movably mounted activation element 26*a* which is intended, as a result of a relative movement, to bring about a winding movement of the wrap-spring element 22*a* of the wrap-spring clutch unit 18*a*. The wrap-spring clutch unit 18*a* comprises at least the activation unit 24*a*, which has at least one movably mounted activation element 26*a* that is mounted so as to be twistable through an angle of less than 360°. The activation element 26*a* is configured as an actuating sleeve. The activation element 26*a* is mounted so as to be twistable relative to the bearing flange 28*a* through an angle of less than 360° about the rotation axis 72*a* of the shaft 14*a*. The bearing flange 28*a* has a receiving region in which the activation element 26*a* is guided in a twistable manner. The activation element 26*a* surrounds the wrap-spring element 22*a*, in particular in a circumferential direction extending about the rotation axis 72*a* of the shaft 14 (FIG. 3). In addition, the activation element 26*a* surrounds the driver element 20*a* and the shaft 14*a*, in particular in the circumferential direction extending about the rotation axis 72*a* of the shaft 14 (FIG. 3).

One end of the wrap-spring element 22*a* is fixed to the bearing flange 28*a*. Furthermore, a further end of the wrap-spring element 22*a* is fixed to the activation element 26*a* of the activation unit 24*a* of the wrap-spring clutch unit 18*a*, said activation element 26*a* being twistable through less than 360°. The wrap-spring element 22*a* has a transverse protrusion 76*a*, by means of which the wrap-spring element 22*a* is fixed to the activation element 26*a*. The activation element 26*a* has a cutout in which the transverse protrusion 76*a* engages. The transverse protrusion 76*a* extends at least substantially perpendicularly to the rotation axis 64*a* of the shaft 14*a*. Furthermore, the wrap-spring element 22*a* has a longitudinal protrusion 78*a*, by means of which the wrap-spring element 22*a* is fixed to the bearing flange 28*a*. The bearing flange 28*a* has a cutout in which the longitudinal protrusion 78*a* engages. The longitudinal protrusion 78*a* extends at least substantially parallel to the rotation axis 64*a* of the shaft 14*a*. However, it is also conceivable for the wrap-spring element 22*a* to be fixed to the activation element 26*a* and/or to the bearing flange 28*a* in some other manner that appears appropriate to a person skilled in the art, for example by means of a screw connection, by means of a clamping connection, by means of a latching connection, or the like.

Furthermore, the activation unit 24*a* has at least one actuator 80*a* (FIG. 3), which is intended to move the activation element 26*a* and/or to hold it in position. Preferably, the actuator 80*a* is configured as a magnetic element, in particular as an electromagnet. However, it is also conceivable for the actuator 80*a* to have some other configuration that appears appropriate to a person skilled in the art, for example a configuration as a spring element, as an electric motor, as a linear drive element, or the like.

The wrap-spring element 22*a* is arranged under pretension on the bearing flange 28*a* and on the driver element 20*a*. A coil internal dimension, in particular a coil inside diameter, of the wrap-spring element 22*a* is smaller than a maximum external dimension, in particular an outside diameter, of the bearing flange 28*a* and smaller than a maximum external dimension, in particular an outside diameter, of the driver element 20*a*, in the region of a bearing position of the bearing flange 28*a* with respect to a mounting of the shaft 14*a*, in particular in an unloaded state of the wrap-spring element 22*a*. The wrap-spring element 22*a* bears against an external surface of the driver element 20*a* and against an external surface of the bearing flange 28*a* in a braking position of the wrap-spring element 22*a*, in particular in the region of the bearing position of the bearing flange 28*a* with respect to a mounting of the shaft 14*a*. Twisting of the driver element 20*a* relative to the bearing flange 28*a* in the rest state of the portable power tool 12*a* can advantageously be prevented. As a result of the connection for conjoint rotation between the driver element 20*a* and the shaft 14*a*, a rotational movement of the shaft 14*a* as a result of a force-fitting connection between the driver element 20*a* and the bearing flange 28*a* is avoidable and/or preventable. In order to enable a rotational movement of the shaft 14*a*, it is necessary to release the force-fitting connection between the driver element 20*a* and the bearing flange 28*a* (FIG. 3). The wrap-spring element 22*a* is able to be unwound in order to release the force-fitting connection between the driver element 20*a* and the bearing flange 28*a*. As a result of the wrap-spring element 22*a* being unwound, individual coils of the wrap-spring element 22*a* are movable away from the driver element 20*a* and the bearing flange 28*a*. During the unwinding of the wrap-spring element 22*a*, the wrap-spring element 22*a*, in particular individual coils of the wrap-spring element 22*a*, come to bear uniformly against an internal surface of the activation element 26*a*. It may be advantageous for brushing of the wrap-spring element 22*a* against the driver element 20*a* rotating in a machining state of the portable power tool 12*a* to be avoided.

The actuator 80*a* is intended to twist the activation element 26*a* and/or hold it in an enabling position in which the wrap-spring element 22*a* is arranged at a distance from the bearing flange 28*a* and from the driver element 20*a* by the activation element 26*a*. As a result of the twisting of the activation element 26*a*, unwinding of the wrap-spring element 22*a* is able to be brought about. The actuator 80*a* is preferably configured as a rotary magnet. When an energy supply, in particular a power supply, of the actuator 80*a* is interrupted, automatic twisting of the activation element 26*a* takes place as a result of a spring force of the wrap-spring element 22*a*. The wrap-spring element 22*a* wraps around the driver element 20*a* and the bearing flange 28*a*. The force-fitting connection between the driver element 20*a* and the bearing flange 28*a* brings about a brake force for braking the shaft 14*a*, which is connected to the driver element 20*a* for conjoint rotation. The actuator 80*a* can be controlled as a result of a sensor signal which is able to be generated in dependence on the occurrence of an uncontrolled blockage of the portable power tool 12*a*.

Figure 4:
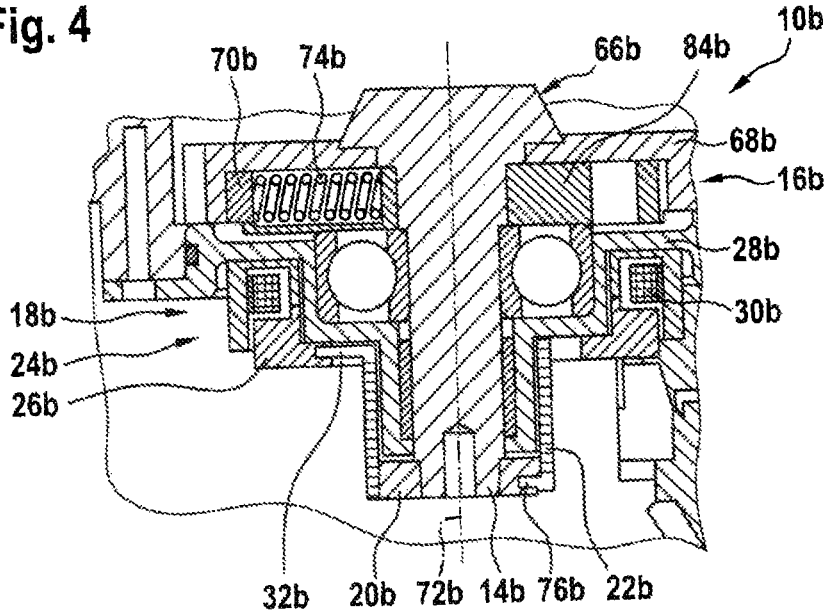
FIG. 4 shows a sectional view of a first alternative protective device according to the disclosure in a schematic illustration.
Figure 5:
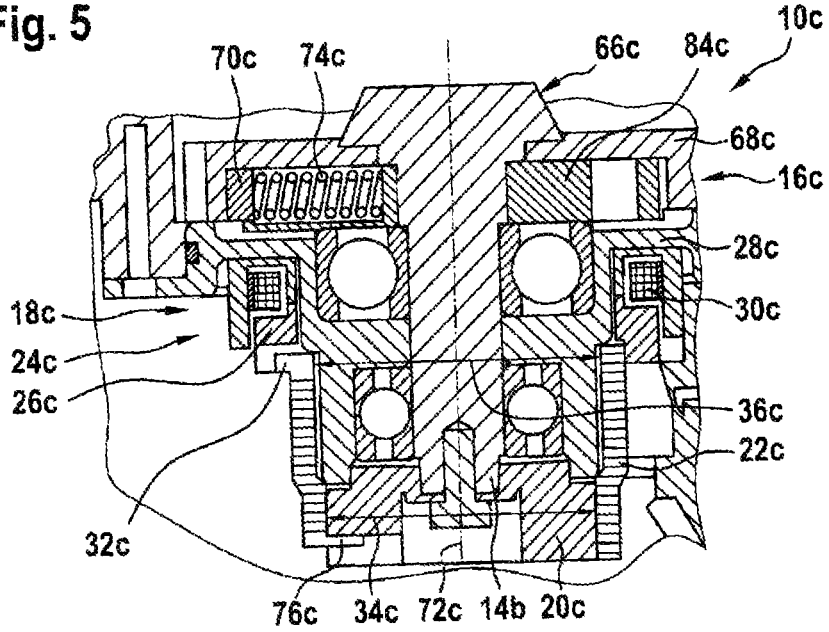
FIG. 5 shows a sectional view of a second alternative protective device according to the disclosure in a schematic illustration.
Figure 6:
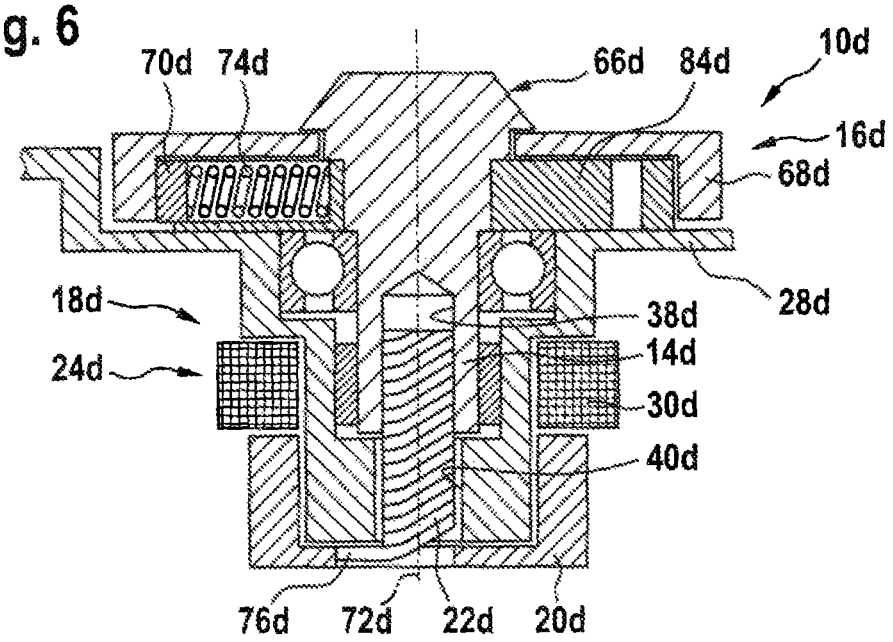
FIG. 6 shows a sectional view of a third alternative protective device according to the disclosure in a schematic illustration.

FIGS. 4 to 6 show further exemplary embodiments of the disclosure. The following descriptions and the drawing are limited substantially to the differences between the exemplary embodiments, wherein, with regard to components with identical designations, in particular with regard to components with identical reference signs, reference can also be made in principle to the drawing and/or the description of the other exemplary embodiments, in particular FIGS. 1 to 3. In order to distinguish between the exemplary embodiments, the letter a is positioned after the reference signs in the exemplary embodiment in FIGS. 1 to 3. In the exemplary embodiments in FIGS. 4 to 6, the letter a is replaced by the letters b to d.

FIG. 4 shows a sectional view of an alternative protective device 10*b*. The protective device 10*b* is intended to protect a user in the event of an uncontrolled blockage of a portable power tool (not illustrated in more detail here). The portable power tool has a configuration analogous to the portable power tool 12*a* described in the description given for FIGS. 1 to 3. The protective device 10*b* comprises at least one rotationally drivable shaft 14*b* and at least one wrap-spring-free overload clutch unit 16*b* which is arranged on the shaft 14*b* and is intended to interrupt transmission of a drive force if a torque limit is exceeded. The protective device 10*b* illustrated in FIG. 4 comprises an at least substantially analogous configuration to the protective device 10*a* described in the description given for FIGS. 1 to 3. In contrast to the protective device 10*a* described in the description given for FIGS. 1 to 3, the protective device 10*b* illustrated in FIG. 4 has a wrap-spring clutch unit 18*b* which comprises at least one wrap-spring element 22*b*, one end of which is fixed to a driver element 20*b*, connected to the shaft 14*b* for conjoint rotation, of the wrap-spring clutch unit 18*b*, and a further end of which is fixed to a rotatably mounted activation element 26*b* of an activation unit 24*b* of the wrap-spring clutch unit 18*b*. In FIG. 4, the wrap-spring element 22*b* is arranged in a rotation-enabling position, in which a rotational movement of the shaft 14*b* is enabled. The activation element 26*b* is arranged in a rotationally movable manner on the bearing flange 28*b*. The activation element 26*b* is rotatably connected to the driver element 20*b* via the wrap-spring element 22*b*. The wrap-spring element 22*b* is fixed to the driver element 20*b* by way of a transverse protrusion 76*b* of the wrap-spring element 22*b*. The wrap-spring element 22*b* is fixed to the activation element 26*b* by way of a further transverse protrusion 32*b* of the wrap-spring element 22*b*.

Furthermore, the protective device 10*b* comprises at least one bearing flange 28*b* on which the shaft 14*b* is rotatably mounted, wherein the activation unit 24*b* has at least one magnetic element 30*b* which, as a result of braking, brought about in particular by a magnetic force of the magnetic element 30*b*, of a rotational movement of the activation element 26*b*, is intended to produce a force fit between the bearing flange 28*b* and the wrap-spring element 22*b*. The magnetic element 30*b* is preferably configured as an electromagnet. However, it is also conceivable for the magnetic element 30*b* to have some other configuration that appears appropriate to a person skilled in the art. As a result of the magnetic element 30*b* being activated, the activation element 26*b* is attractable by a magnetic force of the magnetic element 30*b*. A rotational movement of the activation element 26*b* is brakable by an action of a magnetic force of the magnetic element 30*b*. As a result of a relative movement of the activation element 26*b* relative to the driver element 20*b*, said relative movement being brought about by braking of the activation element 26*b*, the wrap-spring element 22*b* is wound up. The wrap-spring element 22*b* is placeable against the bearing flange 28*b* while it is being wound up. As a result of the wrap-spring element 22*b* bearing thereagainst, a force-fitting connection between the driver element 20*b* and the bearing flange 28*b* is able to be produced via the wrap-spring element 22*b*. The driver element 20*b* is brakable by the force-fitting connection between the driver element 20*b* and bearing flange 28*b*. As a result of the connection for conjoint rotation between the driver element 20*b* and the shaft 14*b*, the shaft 14*b* is likewise brakable while the driver element 20*b* is being braked. With regard to further functions and features of the protective device 10*b* illustrated in FIG. 4, reference may be made to the protective device 10*a* described in the description given for FIGS. 1 to 3.

FIG. 5 shows a sectional view of a further alternative protective device 10*c*. The protective device 10*c* is intended to protect a user in the event of an uncontrolled blockage of a portable power tool (not illustrated in more detail here). The portable power tool has a configuration analogous to the portable power tool 12*a* described in the description given for FIGS. 1 to 3. The protective device 10*c* comprises at least one rotationally drivable shaft 14*c* and at least one wrap-spring-free overload clutch unit 16*c* which is arranged on the shaft 14*c* and is intended to interrupt transmission of a drive force if a torque limit is exceeded. The protective device 10*c* illustrated in FIG. 5 has an at least substantially analogous configuration to the protective device 10*b* described in the description given for FIG. 4. In contrast to the protective device 10*b* described in the description given for FIG. 4, the protective device 10*c* illustrated in FIG. 5 has at least one wrap-spring clutch unit 18*c* which comprises at least one wrap-spring element 22*c* which has two different coil diameters 34*c*, 36*c*. In the region of a driver element 20*c* of the wrap-spring clutch unit 18*c*, the wrap-spring element 22*c* has a smaller coil diameter 34*c* than a coil diameter 36*c* of the wrap-spring element 22*c* in the region of a bearing flange 28*c* of the protective device 10*c*. With regard to further functions and features of the protective device 10*c* illustrated in FIG. 5, reference may be made to the protective device 10*a* described in the description given for FIGS. 1 to 3 and/or to the protective device 10*b* described in the description given for FIG. 4.

FIG. 6 shows a sectional view of a further alternative protective device 10*d*. The protective device 10*d* is intended to protect a user in the event of an uncontrolled blockage of a portable power tool (not illustrated in more detail here). The portable power tool has a configuration analogous to the portable power tool 12*a* described in the description given for FIGS. 1 to 3. The protective device 10*d* comprises at least one rotationally drivable shaft 14*d* and at least one wrap-spring-free overload clutch unit 16*d* which is arranged on the shaft 14*d* and is intended to interrupt transmission of a drive force if a torque limit is exceeded. The protective device 10*d* illustrated in FIG. 6 has an at least substantially analogous configuration to the protective device 10*a* described in the description given for FIGS. 1 to 3. In contrast to the protective device 10*a* described in the description given for FIGS. 1 to 3, the protective device 10*d* illustrated in FIG. 6 has at least one wrap-spring clutch unit 18*d* which comprises at least one wrap-spring element 22*d* which is surrounded at least partially by the shaft 14*d*. In FIG. 6, the wrap-spring element 22*d* is arranged in a rotation-enabling position in which a rotational movement of the shaft 14*d* is enabled. The shaft 14*d* has an internal cutout 38*d* in which the wrap-spring element 22*d* is fixed at least by one end, in particular by means of a force-fitting connection. The wrap-spring element 22*d* has, in particular when considered in an unloaded state of the wrap-spring element 22*d*, a maximum external dimension which is greater than a maximum internal dimension of the internal cutout 38*d*.

Furthermore, the protective device 10*d* comprises at least one bearing flange 28*d* on which the shaft 14*d* is rotatably mounted, wherein the wrap-spring element 22*d* extends through a cutout 40*d* in the bearing flange 28*d*. The wrap-spring element 22*d* extends along a rotation axis 72*d* of the shaft 14*d* through the cutout 40*d* in the bearing flange 28*d*. The cutout 40*d* has a larger internal dimension compared with a maximum external dimension of the wrap-spring element 22*d*, in particular when considered in an unloaded state of the wrap-spring element 22*d*. The wrap-spring element 22*d* is fixed to a driver element 20*d* of the wrap-spring clutch unit 18*d* by a further end, in particular to an internal surface of an internal cutout in the driver element 20*d*. The wrap-spring element 22*d* is intended to connect the driver element 20*d* rotatably to the shaft 14*d*.

Furthermore, the wrap-spring clutch unit 18*d* has at least one magnetic element 30*d* which is intended to cooperate with the driver element 20*d*. The magnetic element 30*d* is preferably configured as an electromagnet. However, it is also conceivable for the magnetic element 30*d* to have some other configuration that appears appropriate to a person skilled in the art. As a result of the magnetic element 30*d* being activated, the driver element 20*d* is attractable by a magnetic force of the magnetic element 30*d*. The driver element 20*d* forms an activation element of an activation unit 24*d* of the wrap-spring clutch unit 18*d*. A rotational movement of the driver element 20*d* is brakable by an action of a magnetic force of the magnetic element 30*d*. As a result of a relative movement of the driver element 20*d* relative to the bearing flange 28*d* and to the shaft 14*d*, said relative movement being brought about by the driver element 20*d* being braked, the wrap-spring element 22*d* is unwound. The wrap-spring element 22*d* is placeable against an internal surface of the cutout 40*d* in the bearing flange 28*d* as a result of unwinding. As a result of the wrap-spring element 22*d* bearing against the internal surface of the cutout 40*d* in the bearing flange 28*d*, a force-fitting connection between the shaft 14*d* and the bearing flange 28*d* is able to be produced via the wrap-spring element 22*d*. The shaft 14*d* is brakable by the force-fitting connection between the shaft 14*d* and the bearing flange 28*d*. With regard to further functions and features of the protective device 10*d* illustrated in FIG. 6, reference may be made to the protective device 10*a* described in the description given for FIGS. 1 to 3.

What is claimed is:

1. A protective device at least for protecting a user in the event of an uncontrolled blockage of a portable power tool, comprising:

at least one rotationally drivable shaft;

at least one wrap-spring-free overload clutch unit which is arranged on the shaft and is configured at least to interrupt transmission of a drive force if a torque limit is exceeded; and at least one wrap-spring clutch unit configured to brake the shaft, wherein the wrap-spring clutch unit comprises:

at least one wrap-spring element, one end of which is fixed to a driver element of the wrap-spring clutch unit, the driver element connected to the shaft for conjoint rotation, and the other end of which is fixed to a rotatably mounted activation element of an activation unit of the wrap-spring clutch unit.

2. The protective device according to claim 1, wherein the at least one wrap-spring element is configured to cooperate with the driver element in order to brake the shaft.

3. The protective device according to claim 1, wherein the at rotatably mounted activation element is configured to bring about a winding movement of a wrap-spring element of the wrap-spring clutch unit as a result of a relative movement.

4. The protective device according to claim 1, wherein the rotatably mounted activation element that is mounted so as to be twistable through an angle of less than 360°.

5. The protective device according to claim 1, further comprising:

at least one bearing flange on which the shaft is rotatably mounted, wherein the at least one wrap-spring element bears against the at least one bearing flange at least during a rotational movement of the shaft and is not in contact with the shaft or with the driver element.

6. The protective device according to claim 5, wherein:

one end of the at least one wrap-spring element is fixed to the bearing flange and another end is fixed to the activation element, and the activation element is twistable through less than 360°.

7. The protective device according to claim 1, further comprising:

at least one bearing flange on which the shaft is rotatably mounted, wherein the activation unit has at least one magnetic element which is configured to produce a force fit between the at least one bearing flange and the wrap-spring element as a result of a rotational movement of the activation element being braked.

8. The protective device according to claim 1, wherein the at least one wrap-spring element includes two different coil diameters.

9. The protective device according to claim 1, wherein the at least one wrap-spring element is surrounded at least partially by the shaft.

10. The protective device according to claim 9, wherein the shaft has an internal cutout in which the wrap-spring element is fixed at least with one end.

11. The protective device according to claim 9, further comprising:

at least one bearing flange on which the shaft is rotatably mounted, wherein the wrap-spring element extends through a cutout in the bearing flange.

12. The protective device according to claim 1, wherein the wrap-spring clutch unit is arranged at an end of the shaft which is remote from a further end of the shaft at which the overload clutch unit is arranged.

13. A portable power tool, comprising:

at least one percussion mechanism unit; and at least one protective device configured to protect a user in the event of an uncontrolled blockage of the portable power tool, the protective device including (i) at least one rotationally drivable shaft, (ii) at least one wrap-spring-free overload clutch unit which is arranged on the shaft and is configured at least to interrupt transmission of a drive force if a torque limit is exceeded, and (iii) at least one wrap-spring clutch unit configured to brake the shaft, wherein the wrap-spring clutch unit comprises:

at least one wrap-spring element, one end of which is fixed to a driver element of the wrap-spring clutch unit, the driver element being connected to the shaft for conjoint rotation, and the other end of which is fixed to a rotatably mounted activation element of an activation unit of the wrap-spring clutch unit.

14. The portable power tool of claim 13, wherein the portable power tool is a hammer drill or a chipping hammer.

15. A protective device at least for protecting a user in the event of an uncontrolled blockage of a portable power tool, comprising:

at least one rotationally drivable shaft;

at least one wrap-spring-free overload clutch unit which is arranged on the shaft and is configured at least to interrupt transmission of a drive force if a torque limit is exceeded; and at least one wrap-spring clutch unit configured to brake the shaft, the wrap-spring clutch unit including:

at least one driver element connected to a free end of the shaft for conjoint rotation; and at least one wrap-spring element configured to cooperate with the at least one driver element in order to brake the shaft, wherein:

one end of the at least one wrap-spring element is fixed to the at least one driver element of the wrap-spring clutch unit, and the other end of which is fixed to a rotatably mounted activation element of an activation unit of the wrap-spring clutch unit.

16. A protective device at least for protecting a user in the event of an uncontrolled blockage of a portable power tool, comprising:

at least one rotationally drivable shaft;

at least one wrap-spring-free overload clutch unit which is arranged on the shaft and is configured at least to interrupt transmission of a drive force if a torque limit is exceeded;

at least one wrap-spring clutch unit configured to brake the shaft; and at least one bearing flange on which the shaft is rotatably mounted, wherein the at least one wrap-spring clutch unit has at least one wrap-spring element which bears against the at least one bearing flange at least during a rotational movement of the shaft and is not in contact with the shaft or with a driver element, arranged on the shaft, of the at least one wrap-spring clutch unit, one end of the at least one wrap-spring element is fixed to the bearing flange and another end is fixed to an activation element of an activation unit of the at least one wrap-spring clutch unit, and the activation element is twistable through less than 360°.

* * * * *